US010377973B2

(12) United States Patent
Lant et al.

(10) Patent No.: US 10,377,973 B2
(45) **Date of Patent: *Aug. 13, 2019**

(54) HAND DISHWASHING LIQUID DETERGENT COMPOSITION

(71) Applicant: The Procter & Gamble Company, Cincinnati, OH (US)

(72) Inventors: Neil Joseph Lant, Newcastle upon Tyne (GB); Robby Renilde Francois Keuleers, Sint Amands (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/161,455

(22) Filed: May 23, 2016

(65) Prior Publication Data

US 2016/0355757 A1 Dec. 8, 2016

(30) Foreign Application Priority Data

Jun. 4, 2015 (EP) ..... 15170746

(51) Int. Cl.

| | |
|---|---|
| ***C11D 3/386*** | (2006.01) |
| ***C11D 1/83*** | (2006.01) |
| ***C11D 1/75*** | (2006.01) |
| ***C11D 11/00*** | (2006.01) |
| ***C11D 1/29*** | (2006.01) |

(52) U.S. Cl.

CPC ..... *C11D 3/38627* (2013.01); *C11D 1/83* (2013.01); *C11D 3/38681* (2013.01); *C11D 1/29* (2013.01); *C11D 1/75* (2013.01)

(58) Field of Classification Search

None

See application file for complete search history.

(56) References Cited

U.S. PATENT DOCUMENTS

| | | | |
|---|---|---|---|
| 5,352,604 | A | 10/1994 | Wilson et al. |
| 5,389,536 | A | 2/1995 | Gray et al. |
| 6,124,127 | A | 9/2000 | Andersen et al. |
| 7,262,042 | B2 | 8/2007 | Weber et al. |
| 2011/0220536 | A1* | 9/2011 | Fernandez-Prieto ..... C07C 237/22 206/524.7 |
| 2013/0203644 | A1 | 8/2013 | Lant et al. |

FOREIGN PATENT DOCUMENTS

| | | | |
|---|---|---|---|
| EP | 0218272 | A1 | 8/1986 |
| EP | 0258068 | A2 | 8/1987 |
| EP | 0305216 | A1 | 8/1988 |
| EP | 0331376 | A2 | 2/1989 |
| EP | 0407225 | A1 | 7/1990 |
| EP | 1921147 | B1 | 2/1995 |
| EP | 1921148 | A3 | 2/1995 |
| EP | 2365050 | A1 | 9/2011 |
| EP | 2623586 | A2 * | 8/2013 |
| GB | 1296839 | | 11/1972 |
| JP | H09-512852 | A | 12/1997 |
| JP | 2013-521401 | A | 6/2013 |
| WO | WO8906270 | A1 | 7/1989 |
| WO | WO8906279 | A1 | 7/1989 |
| WO | WO9205249 | A1 | 4/1992 |
| WO | WO9219729 | A1 | 11/1992 |
| WO | WO9221760 | A1 | 12/1992 |
| WO | WO9318140 | A1 | 9/1993 |
| WO | WO9401541 | A1 | 1/1994 |
| WO | WO9402597 | A1 | 2/1994 |
| WO | WO9418314 | A1 | 8/1994 |
| WO | WO9425578 | A1 | 11/1994 |
| WO | WO9425583 | A1 | 11/1994 |
| WO | WO95/04807 | A1 | 2/1995 |
| WO | WO9506720 | A1 | 3/1995 |
| WO | WO9510603 | A1 | 4/1995 |
| WO | WO9514783 | A1 | 6/1995 |
| WO | WO9522615 | A1 | 8/1995 |
| WO | WO9523221 | A1 | 8/1995 |
| WO | WO95/30729 | A1 | 11/1995 |
| WO | WO9530744 | A1 | 11/1995 |
| WO | WO9535381 | A1 | 12/1995 |
| WO | WO9600292 | A1 | 1/1996 |
| WO | WO9612012 | A1 | 4/1996 |
| WO | WO9613580 | A1 | 5/1996 |
| WO | WO9623873 | A1 | 8/1996 |
| WO | WO9627002 | A1 | 9/1996 |
| WO | WO9634946 | A1 | 11/1996 |
| WO | WO9704079 | A1 | 2/1997 |
| WO | WO9707202 | A1 | 2/1997 |
| WO | WO9743424 | A1 | 11/1997 |
| WO | WO9820115 | A1 | 5/1998 |
| WO | WO9820116 | A1 | 5/1998 |
| WO | WO9905082 | A1 | 2/1999 |
| WO | WO9905084 | A1 | 2/1999 |
| WO | WO9905241 | A1 | 2/1999 |
| WO | WO9905242 | A1 | 2/1999 |
| WO | WO9905243 | A1 | 2/1999 |
| WO | WO9905244 | A1 | 2/1999 |
| WO | WO9907656 | A1 | 2/1999 |
| WO | WO9911768 | A1 | 3/1999 |
| WO | WO9919467 | A1 | 4/1999 |
| WO | WO9927083 | A1 | 6/1999 |
| WO | WO9927084 | A1 | 6/1999 |
| WO | WO9964619 | A1 | 12/1999 |
| WO | WO0023548 | A1 | 4/2000 |
| WO | WO0023549 | A1 | 4/2000 |
| WO | WO0034450 | A1 | 6/2000 |
| WO | WO0060063 | A1 | 10/2000 |
| WO | WO0116285 | A2 | 3/2001 |
| WO | WO0144452 | A1 | 6/2001 |

(Continued)

OTHER PUBLICATIONS

Chica et al. Curr Opin Biotechnol. Aug. 2005;16(4):378-84.*

(Continued)

*Primary Examiner* — Christian L Fronda

(74) *Attorney, Agent, or Firm* — Melissa Krasovec; Dara M. Kendall

(57) ABSTRACT

A hand dishwashing liquid detergent composition having a surfactant system having an anionic surfactant and an amine oxide co-surfactant, a lipase, and preferably at least 0.05% by weight of the composition of at least one monovalent, divalent or trivalent cation or a mixture thereof.

17 Claims, No Drawings

Specification includes a Sequence Listing.

(56) References Cited

FOREIGN PATENT DOCUMENTS

| | | | |
|---|---|---|---|
| WO | WO0166712 | A2 | 9/2001 |
| WO | WO0192453 | A1 | 12/2001 |
| WO | WO0206442 | A2 | 1/2002 |
| WO | WO0210355 | A2 | 2/2002 |
| WO | WO0216547 | A2 | 2/2002 |
| WO | WO0226024 | A1 | 4/2002 |
| WO | WO02092741 | A2 | 11/2002 |
| WO | WO03006602 | A2 | 1/2003 |
| WO | WO03095638 | A1 | 11/2003 |
| WO | WO2004003186 | A2 | 1/2004 |
| WO | WO2004041979 | A2 | 5/2004 |
| WO | WO2005040372 | A1 | 5/2005 |
| WO | WO2005052146 | A2 | 6/2005 |
| WO | WO2005052161 | A2 | 6/2005 |
| WO | WO2006066594 | A2 | 6/2006 |
| WO | WO2007006305 | A1 | 1/2007 |
| WO | WO200704993 | A2 | 4/2007 |
| WO | WO2007087508 | A2 | 8/2007 |
| WO | WO2008153815 | A2 | 12/2008 |
| WO | WO2009021867 | A2 | 2/2009 |
| WO | WO2009061380 | A2 | 5/2009 |
| WO | WO2009109500 | A1 | 9/2009 |
| WO | WO2010065455 | A2 | 6/2010 |
| WO | WO2010104675 | A1 | 9/2010 |
| WO | WO2010107560 | A2 | 9/2010 |
| WO | WO2011000845 | A1 | 1/2011 |
| WO | WO2011036263 | A1 | 3/2011 |
| WO | WO2011036264 | A1 | 3/2011 |
| WO | WO2011084412 | A1 | 7/2011 |
| WO | WO2011084417 | A1 | 7/2011 |
| WO | WO2011084599 | A1 | 7/2011 |
| WO | WO2011098531 | A1 | 8/2011 |
| WO | WO2011/112886 | A1 | 9/2011 |
| WO | WO2011150157 | A2 | 12/2011 |
| WO | WO2012137147 | A1 | 10/2012 |
| WO | WO2013001078 | A1 | 1/2013 |
| WO | WO2013001087 | A2 | 1/2013 |
| WO | WO2013184577 | A1 | 12/2013 |
| WO | WO2014184164 | A1 | 11/2014 |

OTHER PUBLICATIONS

Singh et al. Curr Protein Pept Sci. 2017, 18, 1-11.*

European Search Report for Application No. 17190760.3-1106, dated Jan. 17, 2018, 6 pages.

Extended European Search Report for Application No. 17188957.9-1358, dated Dec. 6, 2017, 6 pages.

International Search Report for International Application Serial No. PCT/US2016/035629, dated Aug. 1, 2016, 10 pages.

International Search Report for International Patent Application Serial No. PCT/US2016/035627, dated Aug. 1, 2016, 10 pages.

XP2774939A—Hand Dishwashing Liquid Detergent Composition, retrieved from internet—Jul. 6, 2017, 2 pages.

* cited by examiner

HAND DISHWASHING LIQUID DETERGENT COMPOSITION

FIELD OF THE INVENTION

The present invention relates to a hand dishwashing detergent composition comprising a surfactant system comprising an anionic surfactant and an amine co-surfactant, a lipase and optionally but preferably a stabilization system. The composition provides good and fast cleaning, in particular grease cleaning and it is stable in storage.

BACKGROUND OF THE INVENTION

Improved grease cleaning is an important need for manual dishwashing detergent users. While lipase enzymes have long been proposed as potential additives to improve the grease cleaning of manual dishwashing detergents, such systems have not been successfully practised due to three key challenges of (i) slow lipase kinetics in a fast manual dishwashing process, (ii) poor enzyme stability during storage and (iii) malodours arising from the action of lipase on short-chain fatty acid residues present in the dairy soil fats. The objective of the present invention is to provide a manual dishwashing detergent that provides effective grease cleaning in short wash processes, exhibits excellent storage stability and low risk of malodour generation during product usage.

SUMMARY OF THE INVENTION

According to a first aspect of the invention, there is provided a hand dishwashing detergent composition. The composition is preferably in liquid form. The composition comprises a surfactant system, a lipase and preferably a stabilization system. In particular, there is provided a hand dishwashing liquid detergent composition comprising at least one lipase, and a surfactant system comprising an anionic surfactant and an amine oxide co-surfactant and optionally but preferably at least 0.05% by weight of the composition of at least one monovalent, divalent or trivalent cation or a mixture thereof.

Without being bound by theory, it is believed that the at least one cation helps the stability of the lipase and in addition, the amine oxide co-surfactant helps to improve the kinetic of the lipase. The cleaning provided by the composition of the invention is very good and fast. The composition does not present malodour issues.

Very good grease cleaning and at the same time very good suds profile have been found when the surfactant system comprises: i) an anionic surfactant; and ii) amine oxide as an amphoteric co-surfactant and preferably a zwitterionic co-surfactant. Preferably the weight ratio of anionic surfactant to co-surfactant is less than 9:1, more preferably less than 5:1, more preferably less than 4:1, even more preferably from about 0.5:1 to about 3.5:1 and especially from about 1:1 to about 3:1. The amine oxide surfactant co-surfactant not only helps cleaning and sudsing but also improves the kinetic of the lipase.

Preferably for use herein are alkoxylated anionic surfactants, more preferably an alkyl alkoxy sulphate. Preferably the alkoxylated anionic surfactant has an average alkoxylation degree of from about 0.2 to about 3, preferably of from about 0.3 to 2, most preferably from about 0.5 to 1. Also preferred are branched anionic surfactants having a weight average level of branching of from about 5% to about 40%.

Another preferred surfactant system for use herein is an anionic and amphoteric and zwitterionic system in which the amphoteric to zwitterionic weight ratio is preferably from about 2:1 to about 1:2, more preferably from about 1.5:1 to about 1:1.5. In particular a system in which the amphoteric surfactant is an amine oxide surfactant and the zwitteronic surfactant is a betaine and the weight ratio of the amine oxide to the betaine is about 1:1. Preferably the amine oxide is C12-14 alkyl dimethyl amine oxide, coco-alkyl dimethyl amine oxide or coco-alkyl amidopropyl dimethyl amine oxide (CAP dimethyl amine oxide). Preferably the betaine is coco-alkyl amidopropyl betaine (CAP-betaine).

Also preferred for use herein are surfactant systems comprising non-ionic surfactants. Preferably the non-ionic surfactant is an ethoxylated alcohol surfactant.

Especially preferred surfactant systems for the composition of the invention comprise an anionic surfactant preferably selected from the group consisting of alkyl sulphate, alkyl alkoxy sulphate and mixtures thereof, more preferably an alkoxylated sulphate, even more preferably an ethoxylated alkyl sulphate, and an amphoteric preferably an zwitterionic co-surfactant, an amino oxide and preferably a betaine co-surfactant, and a non-ionic surfactant, preferably an ethoxylated alcohol nonionic surfactant. In summary, the most preferred surfactant system for use herein comprises an ethoxylated alkyl sulfate surfactant, amine oxide and optionally betaine, and ethoxylated alcohol non-ionic surfactant.

Preferably, the composition of the invention comprises by weight of the composition: from 20 to 80% water, from 5 to 15% of an anionic surfactant, preferably an alkyl ether sulfate, from 0.5 to 3% of amine oxide surfactant, from 0.001-2% of a lipase and preferably from 0.05 to 0.15% of a preservative, and at least 0.05% of a monovalent, divalent or trivalent cation and from 1 to 3% of a corresponding salt.

According to the second aspect of the invention, there is provided a method of manual dishwashing comprising the step of: delivering the detergent composition of the invention to a volume of water and immersing soiled dishware in the water. When the composition of the invention is used according to this method good and fast cleaning is achieved.

For the purpose of this invention "dishware" herein includes cookware and tableware.

According to the last aspect of the invention, there is provided a method of manual dishwashing comprising the step of: delivering the detergent composition of the invention directly onto dishware or onto a cleaning implement and using the cleaning implement to clean the dishware. Preferably the cleaning implement is a sponge and more preferably the sponge is wet. When the composition of the invention is used according to this method good and fast cleaning is achieved.

DETAILED DESCRIPTION OF THE INVENTION

The present invention envisages a hand dishwashing detergent composition. Preferably in liquid form. The detergent composition comprises a surfactant system, a lipase and preferably a stabilization system. It provides very good and fast cleaning, especially grease cleaning even on plastic substrates that are the toughest substrates for grease removal.

The Detergent Composition

The detergent composition is a hand dishwashing detergent, preferably in liquid form. It typically contains from 30% to 95%, preferably from 40% to 90%, more preferably from 50% to 85% by weight of a liquid carrier in which the other essential and optional components are dissolved, dispersed or suspended. One preferred component of the liquid carrier is water.

Preferably the pH of the detergent is adjusted to between 4 and 12, more preferably between 6 and 12 and most preferably between 8 and 10. The pH of the detergent can be adjusted using pH modifying ingredients known in the art.

Enzymes

Additional enzyme(s) which may be comprised in the composition of the invention include one or more enzymes such as protease, cutinase, amylase, carbohydrase, cellulase, pectinase, mannanase, arabinase, galactanase, xylanase, perhydrolase, oxidase, e.g., laccase, and/or peroxidase.

A preferred combination of enzymes comprises, e.g., a protease, lipase and amylase. When present in a composition, the aforementioned additional enzymes may be present at levels from 0.00001 to 2 wt %, from 0.0001 to 1 wt % or from 0.001 to 0.5 wt % enzyme protein by weight of the composition.

Lyases: The lyase may be a pectate lyase derived from *Bacillus*, particularly *B. licheniformis* or *B. agaradhaerens*, or a variant derived of any of these, e.g. as described in U.S. Pat. No. 6,124,127, WO 99/27083, WO 99/27084, WO 02/006442, WO 02/092741, WO 03/095638, Commercially available pectate lyases are XPect™; Pectawash™ and Pectaway™ (Novozymes A/S).

Mannanases: Suitable mannanases include those of bacterial or fungal origin. Chemically or genetically modified mutants are included. The mannanase may be an alkaline mannanase of Family 5 or 26. It may be a wild-type from *Bacillus* or *Humicola*, particularly *B. agaradhaerens, B. licheniformis, B. halodurans, B. clausii*, or *H. insolens*. Suitable mannanases are described in WO 1999/064619. A commercially available mannanase is Mannaway™ (Novozymes A/S).

Proteases: Suitable proteases include those of bacterial, fungal, plant, viral or animal origin e.g. vegetable or microbial origin. Microbial origin is preferred. Chemically modified or protein engineered mutants are included. It may be an alkaline protease, such as a serine protease or a metalloprotease. A serine protease may for example be of the S1 family, such as trypsin, or the S8 family such as subtilisin. A metalloproteases protease may for example be a thermolysin from e.g. family M4 or other metalloprotease such as those from M5, M7 or M8 families.

The term "subtilases" refers to a sub-group of serine protease according to Siezen et al., 1991, Protein Engng. 4: 719-737 and Siezen et al., 1997, Protein Science 6: 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO 2009/021867, and subtilisin *lentus*, subtilisin Novo, subtilisin Carlsberg, *Bacillus licheniformis*, subtilisin BPN', subtilisin 309, subtilisin 147 and subtilisin 168 described in WO 89/06279 and protease PD138 described in (WO 93/18140). Other useful proteases may be those described in WO 92/175177, WO 01/16285, WO 02/026024 and WO 02/016547. Examples of trypsin-like proteases are trypsin (e.g. of porcine or bovine origin) and the *Fusarium* protease described in WO 89/06270, WO 94/25583 and WO 2005/040372, and the chymotrypsin proteases derived from Cellumonas described in WO 2005/052161 and WO 2005/052146.

A further preferred protease is the alkaline protease from *Bacillus lentus* DSM 5483, as described for example in WO 95/23221, and variants thereof which are described in WO 92/21760, WO 95/23221, EP 1921 147 and EP 1921 148.

Examples of metalloproteases are the neutral metalloprotease as described in WO 2007/044993 (Genencor Int.) such as those derived from *Bacillus amyloliquefaciens*. Examples of useful proteases are the variants described in: WO92/19729, WO96/034946, WO98/20115, WO98/20116, WO99/011768, WO01/44452, WO03/006602, WO2004/03186, WO2004/041979, WO2007/006305, WO2011/036263, WO2011/036264, especially the variants with substitutions in one or more of the following positions: 3, 4, 9, 15, 27, 36, 57, 68, 76, 87, 95, 96, 97, 98, 99, 100, 101, 102, 103, 104, 106, 118, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36 D, V68A, N76D, N87S,R, *97E, A98S, S99G,D,A, S99AD, 5101 G,M,R S103A, V104I,Y,N, S106A, G118V,R, H120D,N, N123S, S128L, P129Q, S130A, G160D, Y167A, R170S, A194P, G195E, V199M, V2051, L217D, N218D, M222S, A232V, K235L, Q236H, Q245R, N252K, T274A (using BPN' numbering).

Suitable commercially available protease enzymes include those sold under the trade names Alcalase™, Duralase™, Durazym™, Relase™, Relase™ Ultra, Savinase™, Savinase™ Ultra, Primase™, Polarzyme™, Kannase™, Liquanase™, Liquanase™ Ultra, Ovozyme™ Coronase™, Coronase™ Ultra, Neutrase™, Everlase™ and Esperase™ (Novozymes A/S), those sold under the tradename Maxatase™, Maxacal™, Maxapem™, Purafect™, Purafect Prime™ Preferenz™, Purafect MA™, Purafect Ox™, Purafect OxP™, Puramax™ Properase™, Effectenz™, FN2™, FN3™, FN4™, Excellase™, Opticlean™ and Optimase™ (Danisco/DuPont), Axapem™ (Gist-Brocases N.V.), BLAP (sequence shown in FIG. 29 of U.S. Pat. No. 5,352,604) and variants hereof (Henkel AG) and KAP {*Bacillus alkalophilus* subtilisin) from Kao.

Lipases and Cutinases: Suitable lipases and cutinases include those of bacterial or fungal origin. Chemically modified or protein engineered mutant enzymes are included. Examples include lipase from *Thermomyces*, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), P. sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include Lipolase™, Lipex™; Lipolex™ and Lipoclean™ (Novozymes A/S), Lumafast™ (originally from Genencor) and Lipomax™ (originally from Gist-Brocades).

Amylases: Suitable amylases include alpha-amylases and/or glucoamylases and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839. Suitable amylases include amylases having SEQ ID NO: 2 in WO 95/10603 or variants having 90% sequence identity to SEQ ID NO: 3 thereof. Preferred variants are described in WO 94/02597, WO 94/18314, WO 97/43424 and SEQ ID NO: 4 of WO 99/019467, such as variants with substitutions in one or more of the following positions: 15, 23, 105, 106, 124, 128, 133, 154, 156, 178, 179, 181, 188, 190, 197, 201, 202, 207, 208, 209, 211, 243, 264, 304, 305, 391, 408, and 444.

Different suitable amylases include amylases having SEQ ID NO: 6 in WO 02/010355 or variants thereof having 90% sequence identity to SEQ ID NO: 6. Preferred variants of SEQ ID NO: 6 are those having a deletion in positions 181 and 182 and a substitution in position 193. Other amylases which are suitable are hybrid alpha-amylase comprising residues 1-33 of the alpha-amylase derived from *B. amyloliquefaciens* shown in SEQ ID NO: 6 of WO 2006/066594 and residues 36-483 of the *B. licheniformis* alpha-amylase shown in SEQ ID NO: 4 of WO 2006/066594 or variants having 90% sequence identity thereof. Preferred variants of this hybrid alpha-amylase are those having a substitution, a deletion or an insertion in one of more of the following positions: G48, T49, G107, H156, A181, N190, M197, 1201, A209 and Q264. Most preferred variants of the hybrid alpha-amylase comprising residues 1-33 of the alpha-amylase derived from *B. amyloliquefaciens* shown in SEQ ID NO: 6 of WO 2006/066594 and residues 36-483 of SEQ ID NO: 4 are those having the substitutions:

M197T;

H156Y+A181T+N190F+A209V+Q264S; or

G48A+T49I+G107A+H156Y+A181T+N190F+I201F+A209V+Q264S.

Further amylases which are suitable are amylases having SEQ ID NO: 6 in WO99/019467 or variants thereof having 90% sequence identity to SEQ ID NO: 6. Preferred variants of SEQ ID NO: 6 are those having a substitution, a deletion or an insertion in one or more of the following positions: R181, G182, H183, G184, N195, 1206, E212, E216 and K269. Particularly preferred amylases are those having deletion in positions R181 and G182, or positions H183 and G184.

Additional amylases which can be used are those having SEQ ID NO: 1, SEQ ID NO: 3, SEQ ID NO: 2 or SEQ ID NO: 7 of WO 96/023873 or variants thereof having 90% sequence identity to SEQ ID NO: 1, SEQ ID NO: 2, SEQ ID NO: 3 or SEQ ID NO: 7. Preferred variants of SEQ ID NO: 1, SEQ ID NO: 2, SEQ ID NO: 3 or SEQ ID NO: 7 are those having a substitution, a deletion or an insertion in one or more of the following positions: 140, 181, 182, 183, 184, 195, 206, 212, 243, 260, 269, 304 and 476, using SEQ ID 2 of WO 96/023873 for numbering. More preferred variants are those having a deletion in two positions selected from 181, 182, 183 and 184, such as 181 and 182, 182 and 183, or positions 183 and 184. Most preferred amylase variants of SEQ ID NO: 1, SEQ ID NO: 2 or SEQ ID NO: 7 are those having a deletion in positions 183 and 184 and a substitution in one or more of positions 140, 195, 206, 243, 260, 304 and 476.

Other amylases which can be used are amylases having SEQ ID NO: 2 of WO 08/153815, SEQ ID NO: 10 in WO 01/66712 or variants thereof having 90% sequence identity to SEQ ID NO: 2 of WO 08/153815 or 90% sequence identity to SEQ ID NO: 10 in WO 01/66712. Preferred variants of SEQ ID NO: 10 in WO 01/66712 are those having a substitution, a deletion or an insertion in one of more of the following positions: 176, 177, 178, 179, 190, 201, 207, 211 and 264.

Further suitable amylases are amylases having SEQ ID NO: 2 of WO 09/061380 or variants having 90% sequence identity to SEQ ID NO: 2 thereof. Preferred variants of SEQ ID NO: 2 are those having a truncation of the C-terminus and/or a substitution, a deletion or an insertion in one of more of the following positions: Q87, Q98, 5125, N128, T131, T165, K178, R180, S181. T182, G183, M201, F202, N225, 5243, N272, N282, Y305, R309, D319, Q320, Q359, K444 and G475. More preferred variants of SEQ ID NO: 2 are those having the substitution in one of more of the following positions: Q87E,R, Q98R, S125A, N128C, T131I, T165I, K178L, T182G, M201L, F202Y, N225E,R, N272E, R, S243Q,A,E,D, Y305R, R309A, Q320R, Q359E, K444E and G475K and/or deletion in position R180 and/or S181 or of T182 and/or G183. Most preferred amylase variants of SEQ ID NO: 2 are those having the substitutions:

N128C+K178L+T182G+Y305R+G475K;

N128C+K178L+T182G+F202Y+Y305R+D319T+G475K;

S125A+N128C+K178L+T182G+Y305R+G475K; or

S125A+N128C+T131I+T165I+K178L+T182G+Y305R+G475K wherein the variants are C-terminally truncated and optionally further comprises a substitution at position 243 and/or a deletion at position 180 and/or position 181.

Further suitable amylases are amylases having SEQ ID NO: 1 of W013184577 or variants having 90% sequence identity to SEQ ID NO: 1 thereof. Preferred variants of SEQ ID NO: 1 are those having a substitution, a deletion or an insertion in one of more of the following positions: K176, R178, G179, T180, G181, E187, N192, M199, I203, S241, R458, T459, D460, G476 and G477. More preferred variants of SEQ ID NO: 1 are those having the substitution in one of more of the following positions: K176L, E187P, N192FYH, M199L, I203YF, 5241 QADN, R458N, T459S, D460T, G476K and G477K and/or deletion in position R178 and/or 5179 or of T180 and/or G181. Most preferred amylase variants of SEQ ID NO: 1 are those having the substitutions:

E187P+I203Y+G476K

E187P+I203Y+R458N+T459S+D460T+G476K wherein the variants optionally further comprises a substitution at position 241 and/or a deletion at position 178 and/or position 179.

Further suitable amylases are amylases having SEQ ID NO: 1 of W010104675 or variants having 90% sequence identity to SEQ ID NO: 1 thereof. Preferred variants of SEQ ID NO: 1 are those having a substitution, a deletion or an insertion in one of more of the following positions: N21, D97, V128 K177, R179, S180, 1181, G182, M200, L204, E242, G477 and G478. More preferred variants of SEQ ID NO: 1 are those having the substitution in one of more of the following positions: N21 D, D97N, V128I K177L, M200L, L204YF, E242QA, G477K and G478K and/or deletion in position R179 and/or 5180 or of 1181 and/or G182. Most preferred amylase variants of SEQ ID NO: 1 are those having the substitutions:

N21D+D97N+V128I wherein the variants optionally further comprises a substitution at position 200 and/or a deletion at position 180 and/or position 181.

Other suitable amylases are the alpha-amylase having SEQ ID NO: 12 in WO01/66712 or a variant having at least 90% sequence identity to SEQ ID NO: 12. Preferred amylase variants are those having a substitution, a deletion or an insertion in one of more of the following positions of SEQ ID NO: 12 in WO01/66712: R28, R118, N174; R181, G182, D183, G184, G186, W189, N195, M202, Y298, N299, K302, 5303, N306, R310, N314; R320, H324, E345, Y396, R400, W439, R444, N445, K446, Q449, R458, N471, N484. Particular preferred amylases include variants having a deletion of D183 and G184 and having the substitutions R118K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™ Stainzyme™, Stainzyme Plus™, Natalase™, Liquozyme X™ and BAN™ (from Novozymes A S), and Rapidase™, Purastar™/Effectenz™, Powerase™, Preferenz S1000™, Preferenz S100™ and Preferenz S110™ (from Genencor International Inc./DuPont).

Preferred Lipase for Use Herein

Preferably the lipase is present in the composition of the invention in a level of from 0.001-2%, more preferably from 0.005 to 1.5 and especially from 0.01 to 1% of pure enzyme, by weight of the composition.

The preferred lipase for use herein is a variant of a parent lipase, which variant has lipase activity, has at least 60% but less than 100% sequence identity with SEQ ID NO: 1, and comprises substitutions at positions corresponding to T231R+N233R and at least one or more (e.g., several) of D96E, D111A, D254S, G163K, P256T, G91T and G38A of SEQ ID NO: 1

Preferred lipase for use herein includes lipases in which the variant comprises substitutions of SEQ ID NO: selected from the group consisting of:

a) D96E+T231R+N233R;
b) N33Q+D96E+T231R+N233R;
c) N33Q+D111A+T231R+N233R;
d) N33Q+T231R+N233R+P256T;
e) N33Q+G38A+G91T+G163K+T231R+N233R+D254S;
f) N33Q+G38A+G91T+D96E+D111A+G163K+T231R+N233R+D254S+P256T;
g) D27R+N33Q+G38A+D96E+D111A+G163K+T231R+N233R+D254S+P256T;
h) D27R+N33Q+G38A+G91T+D96E+D111A+G163K+T231R+N233R+P256T;
i) D27R+N33Q+G38A+G91T+D96E+D111A+G163K+T231R+N233R+D254S;
j) D27R+G38A+G91T+D96E+D111A+G163K+T231R+N233R+D254S+P256T;
k) D96E+T231R+N233R+D254S;
l) T231R+N233R+D254S+P256T;
m) G163K+T231R+N233R+D254S;
n) D27R+N33Q+G38A+G91T+D96E+G163K+T231R+N233R+D254S+P256T;
o) D27R+G91T+D96E+D111A+G163K+T231R+N233R+D254S+P256T;
p) D96E+G163K+T231R+N233R+D254S;
q) D27R+G163K+T231R+N233R+D254S;
r) D27R+G38A+G91T+D96E+D111A+G163K+T231R+N233R+D254S;
s) D27R+G38A+G91T+D96E+G163K+T231R+N233R+D254S+P256T;
t) D27R+G38A+D96E+D111A+G163K+T231R+N233R+D254S+P256T:
u) D27R+D96E+G163K+T231R+N233R+D254S;
v) D27R+D96E+D111A+G163K+T231R+N233R+D254S+P256T;
w) D27R+G38A+D96E+G163K+T231R+N233R+D254S+P256T;
x) D111A+G163K+T231R+N233R+D254S+P256T;
y) D111A+T231R+N233R;
z) D111A+T231R+N233R+D254S+P256T;
aa) D27R+D96E+D111A+G163K+T231R+N233R;
bb) D27R+D96E+D111A+T231R+N233R;
cc) D27R+G38A+D96E+D111A+G163K+T231R+N233R+D254S+P256T;
dd) D27R+N33Q+G38A+D96E+D111A+T231R+N233R+D254S+P256T;
ee) D27R+G38A+D96E+D111A+G163K+E210Q+T231R+N233R+D254S+P256T;
ff) D27R+T231R+N233R+D254S+P256T;
gg) D96E+D111A+G163K+T231R+N233R;
hh) D96E+D111A+G163K+T231R+N233R+D254S+P256T;
ii) D96E+D111A+G163K+T231R+N233R+P256T;
jj) D96E+D111A+T231R+N233R;
kk) D96E+D111A+T231R+N233R+D254S;
ll) D96E+D111A+T231R+N233R+D254S+P256T;
mm) D96E+D111A+T231R+N233R+P256T;
nn) D96E+G163K+T231R+N233R+D254S+P256T;
oo) D96E+T231R+N233R+D254S+P256T;
pp) D96E+T231R+N233R+P256T;
qq) G38A+D96E+D111A+T231R+N233R;
rr) G91T+D96E+D111A+G163K+T231R+N233R+D254S+P256T;
ss) G91T+D96E+D111A+T231R+N233R;
tt) G91T+D96E+T231R+N233R;
uu) G91T+T231R+N233R+D254S+P256T;
vv) N33Q+D96E+D111A+G163K+T231R+N233R+D25 4 S+P256T;
ww) T231R+N233R+D254S+P256T; and
xx) T231R+N233R+P256T.

The at Least One Cation

The "at least one cation" of the invention acts as a lipase stabilizing system. The composition of the invention comprises at least 0.05%, preferably at least 0.15%, more preferably at least 0.25% and most preferably at least 0.35% by weight of the composition of at least one monovalent, divalent or trivalent cation or a mixture thereof. The composition preferably comprises from 0.35 to 4%, more preferably from 0.35 to 3%, more preferably from 0.35 to 2% and especially from 0.35 to 1% by weight of the composition of the at least one cation.

Preferably, the cation source the cation source is selected from the inorganic or organic salts of alkali metals, alkaline earth metals, of aluminum, iron, copper and zinc, preferably of the alkali metals and alkaline earth metals, preferably selected from the halides, sulphates, sulphites, carbonates, bicarbonates, phosphates, nitrates, nitrites, phosphates, formates, acetates, propionates, citrates, malates, tartrates, succinates, oxalates, lactates, and mixtures thereof.

More preferably, the cation source is selected from sodium chloride, calcium chloride, potassium chloride, sodium sulfate, potassium sulfate, sodium acetate, potassium acetate, sodium formate, potassium formate, and mixtures thereof; more preferably the cation source is selected from calcium chloride, potassium chloride, potassium sulfate, sodium acetate, potassium acetate, sodium formate and potassium formate, and mixtures thereof and in particular from potassium chloride, potassium sulfate, potassium acetate, potassium formate, and mixtures thereof.

Surfactant System

The liquid detergent can comprise from about 1% to about 50%, preferably from about 5% to about 40% more preferably from about 8% to about 35% by weight thereof of a surfactant system. The surfactant system comprises an anionic surfactant, preferably an alkoxylated sulfate anionic surfactant. Most preferably the system further comprises an amphoteric and/or zwitterionic surfactant, and optionally a non-ionic surfactant.

Preferably, the anionic surfactant system comprises alkyl sulfates and/or alkyl ethoxy sulfates; more preferably a combination of alkyl sulfates and/or alkyl ethoxy sulfates with a combined average ethoxylation degree of less than 5, preferably from about 0.2 to about 3, more preferably from about 0.3 to about 2, even more preferably from 0.5 to about 1. Preferably the anionic surfactant system has an average level of branching of from about 5% to about 40%.

Preferably, the composition of the present invention will comprise amphoteric (amine oxide co-surfactant and optionally a zwitterionic co-surfactant, more preferably an amine oxide and optionally but preferably a betaine co-surfactant. The composition can comprise from about 0.01% to about 25% wt, preferably from about 0.2% to about 20% wt, more preferably from about 0.5% to about 15% by weight of the composition of co-surfactant.

The composition can further comprise a nonionic surfactant, preferably an alkoxylated alcohol nonionic surfactant, even more preferably an ethoxylated nonionic surfactant.

The most preferred surfactant system for the detergent composition of the present invention will therefore comprise: (1) 1% to 40%, preferably 6% to 32%, more preferably 8% to 25% weight of the total composition of an anionic surfactant, preferably an alkoxylated sulfate surfactant (2) combined with 0.01% to 25% wt, preferably from 0.2% to 20% wt, more preferably from 0.5% to 15% by weight of the composition of co-surfactant, an amphoteric amine oxide co-surfactant. It has been found that such surfactant system in combination with the lipase will provide the excellent cleaning required from a hand dishwashing detergent.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C8-C22 alkyl, or acyl group. Such surfactants are employed in the form of water-soluble salts and the salt-forming cation usually is selected from sodium, potassium, ammonium, magnesium and mono-, di- or tri-C2-C3 alkanolammonium, with the sodium, cation being the usual one chosen.

The anionic surfactant can be a single surfactant but usually it is a mixture of anionic surfactants. Preferably the anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

Preferably the anionic surfactant is alkoxylated, more preferably, an alkoxylated branched anionic surfactant having an alkoxylation degree of from about 0.1 to about 4, even more preferably from about 0.2 to about 3, even more preferably from about 0.3 to about 2 and especially from about 0.5 to about 1. Preferably, the alkoxy group is ethoxy. When the branched anionic surfactant is a mixture of surfactants, the alkoxylation degree is the weight average alkoxylation degree of all the components of the mixture (weight average alkoxylation degree). In the weight average alkoxylation degree calculation the weight of anionic surfactant components not having alkoxylated groups should also be included.

Weight average alkoxylation degree=
($x1$*alkoxylation degree of surfactant 1+$x2$*alkoxylation degree of surfactant 2+ . . . )/($x1$+$x2$+ . . . )

wherein x1, x2, . . . are the weights in grams of each anionic surfactant of the mixture and alkoxylation degree is the number of alkoxy groups in each anionic surfactant.

Preferably the anionic surfactant to be used in the detergent of the present invention is a branched anionic surfactant having a level of branching of from about 5% to about 40%, preferably from about 10 to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the anionic surfactant used in the detergent of the invention. Most preferably the branched anionic surfactant is selected from alkyl sulphates, alkyl ethoxy sulphates, and mixtures thereof.

The branched anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/($x1$+$x2$+ . . . )]*100 wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Preferably, the anionic surfactant system comprises an alkyl ethoxylated sulphate having an average ethoxylation degree of from about 0.2 to about 3 and preferably a level of branching of from about 5% to about 40%.

Sulphate Surfactants

Suitable sulphate surfactants for use herein include water-soluble salts of C8-C18 alkyl or hydroxyalkyl, sulphate and/or ether sulfate. Suitable counterions include alkali metal cation or ammonium or substituted ammonium, but preferably sodium.

The sulphate surfactants may be selected from C8-C18 primary, branched chain and random alkyl sulphates (AS);

C8-C18 secondary (2,3) alkyl sulphates; C8-C18 alkyl alkoxy sulphates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulphates include, those based on Neodol alcohols ex the Shell company, Lial-Isalchem and Safol ex the Sasol company, natural alcohols ex The Procter & Gamble Chemicals company.

Preferably, the branched anionic surfactant comprises at least 50%, more preferably at least 60% and especially at least 70% of a sulphate surfactant by weight of the branched anionic surfactant. Especially preferred detergents from a cleaning view point art those in which the branched anionic surfactant comprises more than 50%, more preferably at least 60% and especially at least 70% by weight thereof of sulphate surfactant and the sulphate surfactant is selected from the group consisting of alkyl sulphate, alkyl ethoxy sulphates and mixtures thereof. Even more preferred are those in which the branched anionic surfactant has a degree of ethoxylation of from about 0.2 to about 3, more preferably from about 0.3 to about 2, even more preferably from about 0.4 to about 1.5, and especially from about 0.5 to about 1 and even more preferably when the anionic surfactant has a level of branching of from about 10% to about 35%, %, more preferably from about 20% to 30%.

Sulphonate Surfactants

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Nonionic Surfactants

Nonionic surfactant, when present, is comprised in a typical amount of from 0.1% to 30%, preferably 0.2% to 20%, more preferably 0.3% to 10%, most preferably 0.5-5% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

An alternative nonionic surfactant could be selected from the group of alkyl polyglucoside surfactants (APG's).

Amine Oxide Co-Surfactant

Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or branched alkyl moiety. Typical amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) 0 wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. The amine oxide further comprises two moieties R2 and R3, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Co-Surfactant

Other suitable co-surfactants include betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad \text{(I) wherein}$$

- $R^1$ is a saturated or unsaturated C6-22 alkyl residue, preferably C8-18 alkyl residue, in particular a saturated C10-16 alkyl residue, for example a saturated C12-14 alkyl residue;
- X is NH, $NR^4$ with C1-4 Alkyl residue $R^4$, 0 or S,
- n a number from 1 to 10, preferably 2 to 5, in particular 3,
- x 0 or 1, preferably 1,
- $R^2$, $R^3$ are independently a C1-4 alkyl residue, potentially hydroxy substituted such as a hydroxyethyl, preferably a methyl.
- m a number from 1 to 4, in particular 1, 2 or 3,
- y 0 or 1 and
- Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$$R^1—CO—NH—(CH_2)_3—N^+(CH_3)_2—CH_2CH(OH)CH_2SO_3— \quad \text{(Id)}$$

in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropyl-betain.

The detergent composition herein may comprise a number of optional ingredients such as builders, chelants, conditioning polymers, cleaning polymers, surface modifying polymers, soil flocculating polymers, structurants, emmolients, humectants, skin rejuvenating actives, carboxylic acids, scrubbing particles, bleach and bleach activators, perfumes, malodor control agents, pigments, dyes, opacifiers, beads, pearlescent particles, microcapsules, diamines, antibacterial agents, preservatives and pH adjusters and buffering means.

Method of Washing

Other aspects of the invention are directed to methods of washing dishware with the composition of the present invention. Said methods comprise the step of applying the composition, preferably in liquid form, onto the dishware surface, either in diluted or neat form and rinsing or leaving the composition to dry on the surface without rinsing the surface.

By "in its neat form", it is meant herein that said composition is applied directly onto the surface to be treated and/or onto a cleaning device or implement such as a dish cloth, a sponge or a dish brush without undergoing any dilution (immediately) prior to the application. The cleaning device or implement is preferably wet before or after the composition is delivered to it.

By "diluted form", it is meant herein that said composition is diluted by the user with an appropriate solvent, typically water. By "rinsing", it is meant herein contacting the dishware cleaned using a process according to the present invention with substantial quantities of appropriate solvent, typically water, after the step of applying the liquid composition herein onto said dishware. By "substantial quantities", it is meant usually about 1 to about 10 liters.

The composition herein can be applied in its diluted form. Soiled dishes are contacted with an effective amount, typically from about 0.5 ml to about 20 ml (per about 25 dishes being treated), preferably from about 3 ml to about 10 ml, of the detergent composition, preferably in liquid form, of the present invention diluted in water. The actual amount of detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device at weight ratios ranging from about 95:5 to about 5:95, preferably about 80:20 to about 20:80 and more preferably about 70:30 to about 30:70, respectively, of hand dishwashing liquid:water respectively depending upon the user habits and the cleaning task.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

Examples of Hand Dishwashing formulations comprising a lipase.

| | 1 Wt % | 2 Wt % | 3 Wt % | 4 Wt % | 5 Wt % | 6 Wt % | 7 Wt % |
|---|---|---|---|---|---|---|---|
| Alkyl $C_{10-14}$ Ethoxy Sulphate (AE0.6S) | 26.9 | 21 | — | — | — | 5 | 15 |
| Alkyl $C_{10-14}$ Ethoxy Sulphate (AE2S) | — | — | 18 | 14 | 13 | — | — |
| Sodium alkyl benzene sulfonate | — | — | — | — | — | 8 | — |
| Sodium paraffin sulfonate | — | — | — | 6 | — | — | — |
| C12-14 dimethyl amine oxide | 6.1 | 7 | 6 | 5 | — | — | 6 |
| Cocamido propyl betaine | — | — | 8 | 5 | 4 | 2 | 4 |
| C12-13 EO7 nonionic | — | — | 0.2 | 0.1 | 0.5 | 2 | — |
| Branched Nonionic: 3-propyl heptanol EO8 | 1.0 | 0.5 | — | — | — | — | 1.0 |
| PEI600-EO10-PO7 block polymer | — | 0.5 | — | — | — | 0.4 | 0.8 |
| Lipase | 0.02 | 0.02 | 0.001 | 0.03 | 0.1 | 0.01 | 0.02 |
| Protease | — | 0.04 | — | — | — | — | — |
| Amylase | 0.04 | 0.02 | 0.06 | 0.2 | 0.2 | 0.05 | 0.02 |
| 4-Formylphenylboronic acid | — | 0.1 | — | — | — | — | — |
| Potassium chloride | 1.5 | — | — | — | — | — | — |
| Calcium chloride | — | 1 | — | — | — | — | — |
| Sodium acetate | — | — | 1.5 | — | — | — | — |
| Potassium acetate | — | — | — | 2 | — | — | — |
| Sodium sulfate | — | — | — | — | 1 | — | — |
| Potassium sulfate | — | — | — | — | — | 1.5 | — |
| Potassium formate | — | — | — | — | — | — | 2 |
| Ethanol | 4.0 | 5.0 | 3.0 | 3.0 | 2.0 | — | 3.0 |
| Polypropylene glycol MW2000 | 1.1 | 0.8 | 1.1 | 1.1 | 1.1 | 0.5 | 1.1 |
| Sodium chloride | 1.3 | 0.8 | 1.3 | 0.5 | 0.8 | 1.3 | 1.3 |
| Minors* and water | | | to balance up to 100% | | | | |

Lipase is the D27R+G38A+D96E+D111A+G163K+T231R+N233R+D254S+P256T variant of SEQ ID: 1, supplied by Novozymes A/S, Bagsvaerd, Denmark. Protease is Savinase®, supplied by Novozymes A/S, Bagsvaerd, Denmark. Amylase is Stainzyme® supplied by Novozymes A/S, Bagsvaerd, Denmark

SEQUENCE LISTING

```
<160> NUMBER OF SEQ ID NOS: 1

<210> SEQ ID NO 1
<211> LENGTH: 269
<212> TYPE: PRT
<213> ORGANISM: Thermomyces lanuginosus

<400> SEQUENCE: 1

Glu Val Ser Gln Asp Leu Phe Asn Gln Phe Asn Leu Phe Ala Gln Tyr
1               5                   10                  15

Ser Ala Ala Ala Tyr Cys Gly Lys Asn Asn Asp Ala Pro Ala Gly Thr
            20                  25                  30

Asn Ile Thr Cys Thr Gly Asn Ala Cys Pro Glu Val Glu Lys Ala Asp
        35                  40                  45

Ala Thr Phe Leu Tyr Ser Phe Glu Asp Ser Gly Val Gly Asp Val Thr
    50                  55                  60

Gly Phe Leu Ala Leu Asp Asn Thr Asn Lys Leu Ile Val Leu Ser Phe
65                  70                  75                  80

Arg Gly Ser Arg Ser Ile Glu Asn Trp Ile Gly Asn Leu Asn Phe Asp
                85                  90                  95

Leu Lys Glu Ile Asn Asp Ile Cys Ser Gly Cys Arg Gly His Asp Gly
```

-continued

```
            100                 105                 110

Phe Thr Ser Ser Trp Arg Ser Val Ala Asp Thr Leu Arg Gln Lys Val
        115                 120                 125

Glu Asp Ala Val Arg Glu His Pro Asp Tyr Arg Val Val Phe Thr Gly
    130                 135                 140

His Ser Leu Gly Gly Ala Leu Ala Thr Val Ala Gly Ala Asp Leu Arg
145                 150                 155                 160

Gly Asn Gly Tyr Asp Ile Asp Val Phe Ser Tyr Gly Ala Pro Arg Val
                165                 170                 175

Gly Asn Arg Ala Phe Ala Glu Phe Leu Thr Val Gln Thr Gly Gly Thr
            180                 185                 190

Leu Tyr Arg Ile Thr His Thr Asn Asp Ile Val Pro Arg Leu Pro Pro
        195                 200                 205

Arg Glu Phe Gly Tyr Ser His Ser Ser Pro Glu Tyr Trp Ile Lys Ser
    210                 215                 220

Gly Thr Leu Val Pro Val Thr Arg Asn Asp Ile Val Lys Ile Glu Gly
225                 230                 235                 240

Ile Asp Ala Thr Gly Gly Asn Asn Gln Pro Asn Ile Pro Asp Ile Pro
                245                 250                 255

Ala His Leu Trp Tyr Phe Gly Leu Ile Gly Thr Cys Leu
            260                 265
```

What is claimed is:

1. A hand dishwashing liquid detergent composition comprising i. a surfactant system comprising an anionic surfactant and an amine oxide co-surfactant;

ii. a lipase; and iii. at least 0.05% by weight of the composition of at least one cation, wherein said cation is selected from potassium chloride, potassium sulfate, potassium acetate, potassium formate, and mixtures thereof.

2. The composition according to claim 1 wherein said anionic surfactant comprises an alkyl alkoxy sulphate.

3. A composition according to claim 1 wherein said anionic surfactant and said amine oxide co-surfactant are in a weight ratio of from about 0.5:1 to about 3.5:1.

4. A composition according to claim 1 wherein said lipase is a variant of a parent lipase, such variant having lipase activity of at least about 60% but less than about 100% sequence identity with SEQ ID NO: 1, and comprises substitutions at positions corresponding to T231R+N233R and at least one or more of D96E, D111A, D254S, G163K, P256T, G91T and G38A of SEQ II) NO: 1.

5. A composition according claim 4 wherein said variant further comprises substitutions at positions corresponding to D27R and/or N33Q of SEQ ID NO: 1.

6. A composition according to claim 4 wherein said variant comprises substitutions of SEQ ID NO: 1 selected from the group consisting of:

a) D96E+T231R+N233R;

b) N33Q+D96E+T231R+N233R;

c) N33Q+D111A+T231 R+N233R;

d) N33Q+T231 R+N233R+P256T;

e) N33Q+G38A+G91T+G163K+T231R+N233R+D254S;

f) N33Q+G38A+G91T+D96E+D111A+G163K+T231R+N233R+D254S+P256T;

g) D27R+N33Q+G38A+D96E+D111A+G163K+T231 R+N233R+D254S+P256T;

h) D27R+N33Q+G38A+G91T+D96E+D111A+G163K+T231 R+N233R+P256T;

i) D27R+N33Q+G38A+G91T+D96E+D111A+G163K+T231 R+N233R+D254S;

j) D27R+G38A+G91T+D96E+D111A+G163K+T231 R+N233R+D254S+P256T;

k) D96E+T231 R+N233R+D254S;

l) T231R+N233R+D254S+P256T;

m) G163K+T231 R+N233R+D254S;

n) D27R+N33Q+G38A+G91T+D96E+G163K+T231 R+N233R+D254S+P256T;

o) D27R+G91T+D96E+D111A+G163K+T231 R+N233R+D254S+P256T;

p) D96E+G163K+T231 R+N233R+D254S;

q) D27R+G163K+T231 R+N233R+D254S;

r) D27R+G38A+G91T+D96E+D111A+G163K+T231 R+N233R+D254S;

s) D27R+G38A+G91T+D96E+G163K+T231 R+N233R+D254S+P256T;

t) D27R+G38A+D96E+D111A+G163K+T231 R+N233R+D254S+P256T:

u) D27R+D96E+G163K+T231R+N233R+D254S;

v) D27R+D96E+D111A+G163K+T231R+N233R+D254S+P256T;

w) D27R+G38A+D96E+G163K+T231 R+N233R+D254S+P256T;

x) D111A+G163K+T231R+N233R+D254S+P256T;

y) D111A+T231R+N233R;

z) D111A+T231 R+N233R+D254S+P256T;

aa) D27R+D96E+D111A+G163K+T231R+N233R;

bb) D27R+D96E+D111A+T231 R+N233R;

cc) D27R+G38A+D96E+D111A+G163K+T231R+N233R+D254S+P256T;

dd) D27R+N33Q+G38A+D96E+D111A+T231R+N233R+D254S+P256T;

ee) D27R+G38A+D96E+D111A+G163K+E210Q+T231 R+N233R+D254S+P256T;

ff) D27R+T231 R+N233R+D254S+P256T;
gg) D96E+D111A+G163K+T231R+N233R;
hh) D96E+D111A+G163K+T231R+N233R+D254S+P256T;
ii) D96E+D111A+G163K+T231R+N233R+P256T;
jj) D96E+D111A+T231R+N233R;
kk) D96E+D111A+T231R+N233R+D254S;
ll) D96E+D111A+T231R+N233R+D254S+P256T;
mm) D96E+D111A+T231R+N233R+P256T;
nn) D96E+G163K+T231R+N233R+D254S+P256T;
oo) D96E+T231R+N233R+D254S+P256T;
pp) D96E+T231R+N233R+P256T;
qq) G38A+D96E+D111A+T231 R+N233R;
rr) G91T+D96E+D111A+G163K+T231R+N233R+D254S+P256T;
ss) G91T+D96E+D111A+T231 R+N233R;
tt) G91T+D96E+T231 R+N233R;
uu) G91T+T231 R+N233R+D254S+P256T;
vv) N33Q+D96E+D111A+G163K+T231R+N233R+D254S+P256T;
ww) T231R+N233R+D254S+P256T; and
xx) T231R+N233R+P256T.

7. A composition according to claim 1 wherein said composition comprises at least 0.35% by weight of the composition of said cation.

8. A composition according to claim 1 wherein said composition comprises from about 0.35 to about 4% by weight of the composition of said cation.

9. A composition according to claim 1 having a pH of from 4 to 9 as measured in a 10% aqueous solution in distilled water at 2.0° C.

10. A composition according to claim 1 wherein said composition comprises water, from about 5 to about 15% by weight of the composition of an anionic surfactant, wherein said anionic surfactant is an alkyl ether sulfate, from about 0.8 to about 3% of art amine oxide co-surfactant, from about 0.001-2% of a lipase, at least about 0.05% of a monovalent, divalent or trivalent cation and from about 1 to about 3% of a corresponding salt.

11. A composition according to claim 1 wherein said composition further comprises a zwitterionic surfactant, wherein said zwitterionic surfactant is a betaine surfactant.

12. A composition according to claim 1 wherein said composition further comprises a nonionic surfactant, wherein said nonionic surfactant is an alcohol ethoxylate surfactant.

13. A composition according to claim 1 wherein said composition further comprises an amylase and or a protease.

14. A composition according to claim 1 wherein said composition further comprises front about 0.001 to about 2% by weight of the composition of lipase.

15. A composition according to claim 1 wherein said composition further comprises a zwitteronic surfactant and wherein said anionic surfactant and said amine oxide co-surfactant and zwitteronic surfactant are in a weight ratio of from about 0.5:1 to about 3.5:1.

16. A method of manually washing dishware comprising the steps of: delivering a composition according to claim 1 to a volume of water to form a wash liquor and immersing the dishware in the liquor.

17. A method of manually washing dishware comprising the steps of: delivering a composition according to claim 1 directly onto the dishware or onto a cleaning implement and using said cleaning implement to clean the dishware.

* * * * *